US007221771B1

(12) United States Patent
DeKalb et al.

(10) Patent No.: US 7,221,771 B1
(45) Date of Patent: May 22, 2007

(54) OVER-THE-EAR HEADSET

(75) Inventors: Fred DeKalb, Ben Lomond, CA (US); Ric Baughman, Hollister, CA (US)

(73) Assignee: Plantronics, Inc., Santa Cruz ( * ) Notice: Subject to any disclaimer, the term of this patent is extended or adjusted under 35 U.S.C. 154(b) by 639 days.

(21) Appl. No.: 10/376,854

(22) Filed: Feb. 27, 2003

(51) Int. Cl.
*H04R 25/00* (2006.01)

(52) U.S. Cl. ..... 381/381; 381/370; 381/384

(58) Field of Classification Search ..... 381/309, 381/330, 370, 371, 374, 375, 376, 378, 379, 381/381, 71.6, 71.7; 379/430; 181/128, 181/129, 130, 135
See application file for complete search history.

(56) References Cited

U.S. PATENT DOCUMENTS 5,761,298 A 6/1998 Davis et al.
5,903,644 A * 5/1999 Scheider et al. ..... 379/430
6,449,374 B1 9/2002 Skulley et al.

* cited by examiner

*Primary Examiner*—Huyen Le
(74) *Attorney, Agent, or Firm*—MacPherson Kwok Chen & Heid LLP

(57) ABSTRACT

The present invention provides an over-the-ear headset and donning method which advantageously allow for improved comfort, sound quality, and stability on the ear. In accordance with the present invention, the headset includes an earhook, and a bias structure connected to the earhook. An extension member is connected to the bias structure, and a receiver capsule is movably connected to an end of the extension member. The headset advantageously provides bias forces both behind the user's ear and substantially normal to the orientation of the user's outer ear, allowing for improved acoustic coupling to the ear and enhanced sound quality.

24 Claims, 4 Drawing Sheets

OVER-THE-EAR HEADSET

BACKGROUND OF THE INVENTION

1. Field of Invention

This invention generally relates to headsets and, more particularly, to an "over-the-ear" type headset apparatus with improved wearing stability, universal fit, and sound quality.

2. Discussion of the Related Art

Headsets are gaining in popularity as more users either have jobs requiring that they spend a substantial amount of time on the telephone or simply desire to listen to audio or speak on the telephone with their hands free to perform other tasks.

One type of headset, which can incorporate one or two earphones for monaural or stereo listening, is known as an "over-the-ear" type headset, which employs an earhook attached to an earphone that can be disposed over the ear of a user. Such devices can be used for delivering audio, such as radio, stereo, two-way, and/or telephonic-type communications, to a user.

Unfortunately, over-the-ear style headsets often do not fit properly because of the large natural variation in the size, shape, and orientation of human ears. Thus, hands-free headsets which are placed over the ear must adapt to a wide variety of ear shapes and sizes in order to fit a large percentage of users. Comfort, stability, and high sound quality are key elements that must be met in order for a headset to be acceptable to the end user. However, different ear shapes and sizes make it difficult for a single design to both fit the ear correctly and stabilize the headset. Lack of good coupling to the ear results in unclear transmission of sound from the transducer and inability to block out external noise. Headsets including a microphone coupled by a boom cause additional complexity as these headsets need to support the weight and movement of the boom.

Therefore, there is a need in the art for an over-the-ear headset that is comfortable, stable on the ear, universally fitting for a wide variety of ear shapes, sizes, and orientations, and provides high sound quality. What is also needed is an over-the-ear headset that can be easily grasped, opened, and positioned on an ear with only one hand.

SUMMARY

The present invention provides an over-the-ear headset including an earhook, a bias structure, an extension member, and a movably-coupled receiver capsule that work in combination to allow for greater acoustic coupling with the outer ear. Advantageously, the present invention allows for improved comfort, sound quality, and positional stability.

According to one embodiment of the present invention, an over-the-ear headset is provided, including an earhook and a bias structure connected to the earhook. An extension member is connected to the bias structure, and a receiver capsule is connected to an end of the extension member.

According to another embodiment of the present invention, an over-the-ear headset is provided, including an earhook adapted to fit at least partially behind an ear in substantially a first plane to grasp the ear. The over-the-ear headset further includes a bias clamp that has a first arm and a second arm coupled by a spring. An end of the earhook is connected to the first arm of the bias clamp. An extension member is connected to the second arm of the bias clamp, and a receiver capsule is connected to an end of the extension member.

According to another embodiment of the present invention, an over-the-ear headset is provided, including an earhook and a bias structure with a forked section. The forked section includes a first projection and a second projection. An end of the earhook is connected to the first projection and an extension member is connected to the second projection. A receiver capsule is connected to a free end of the extension member.

According to another embodiment of the present invention, a method of donning an over-the-ear headset is provided, including providing force on the bias structure to move the receiver capsule away from the earhook. The earhook is positioned behind the ear and the receiver capsule is positioned over the ear. The method also includes removing the force on the bias structure to bias the receiver capsule against the ear.

Advantageously, the headset and donning method of the present invention allow a headset to fit ears of various sizes while providing enhanced sound quality and positional stability.

These and other features and advantages of the present invention will be more readily apparent from the detailed description of the embodiments set forth below taken in conjunction with the accompanying drawings.

BRIEF DESCRIPTION OF DRAWINGS

Use of the same reference symbols in different figures indicates similar or identical items. It is further noted that the drawings may not be drawn to scale.

DETAILED DESCRIPTION

Figure 1A:
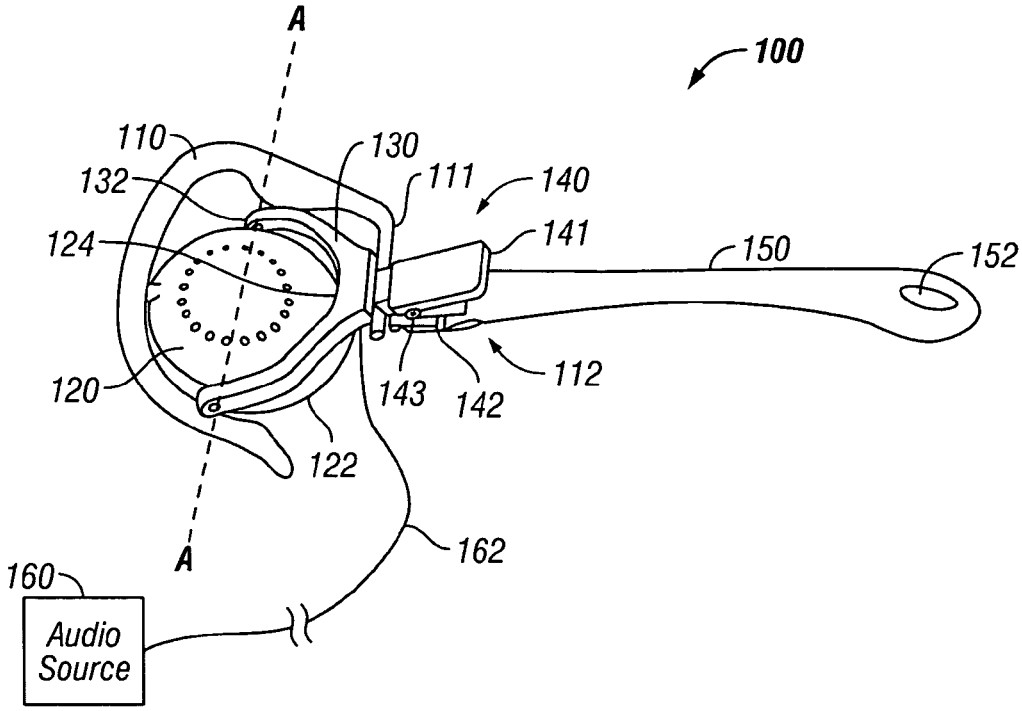
FIG. 1A illustrates a perspective view of an over-the-ear headset in a closed or relaxed configuration in accordance with an embodiment of the present invention.
Figure 1B:
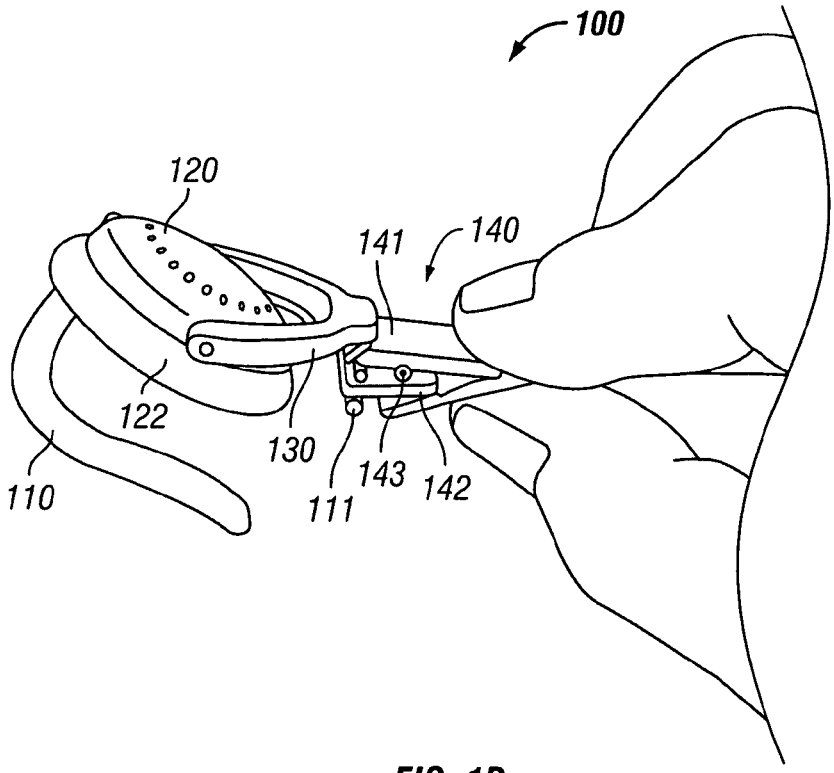
FIG. 1B illustrates a perspective view of the over-the-ear headset in an open or flexed configuration in accordance with an embodiment of the present invention.
Figure 1C:
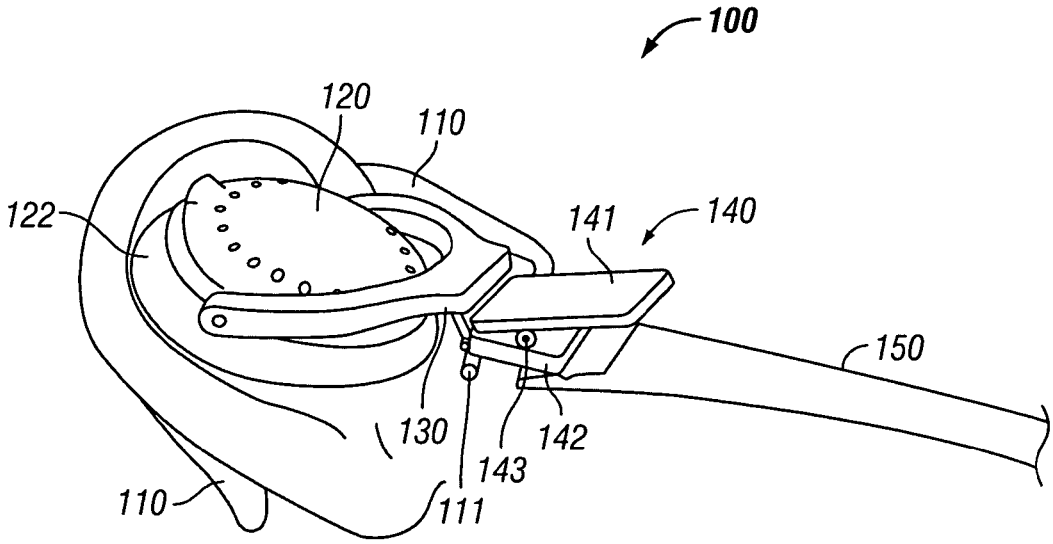
FIG. 1C illustrates a perspective view of the over-the-ear headset mounted on a model ear in accordance with an embodiment of the present invention.

FIGS. 1A–1C illustrate perspective views of an over-the-ear headset 100 in a substantially closed or static configuration, an open or flexed configuration, and a mounted configuration, respectively, in accordance with an embodiment of the present invention.

Referring in particular to FIG. 1A, over-the-ear headset 100 includes an earhook 110 and a receiver/transmitter assembly 112 in a closed or static configuration.

An example of an earhook 110 that may be used in accordance with the present invention, with no intent to limit the invention thereby, is a rigid earhook formed in an arcuate or crescent shape to fit behind the ear substantially along a first plane, similar to a temple of a pair of ordinary eyeglasses. Earhook 110 may be formed using any of a number of commercially available, high performance thermoplastics, such as ABS, propylene, Hytrel, Delrin, or nylon, all of which are well known to those skilled in the art. Many different materials with similar properties could also be used.

Another example of an earhook that may be used is the conformable earhook described in U.S. Pat. No. 6,449,374, issued on Sep. 10, 2002, to Skulley et al. for "Conformable Earhook For an Over-the-ear Headset," which is commonly assigned and incorporated herein by reference for all purposes.

It is noted that the above described embodiments of an earhook are simply examples of an earhook that may be used in accordance with the present invention. Various other appropriate earhooks that are adapted to at least fit behind a ear may also be utilized within the scope of the present invention.

An end of earhook 110 is rigidly coupled to audio receiver/transmitter assembly 112. Various methods may be used to join earhook 110 to audio receiver/transmitter assembly 112, such as for example, by adhesive or welding. A joining end 111 of earhook 110 is shown in FIGS. 1A–1C for connecting earhook 110 to receiver/transmitter assembly 112.

Receiver/transmitter assembly 112 includes a receiver capsule 120, an extension member 130, a bias structure 140, and a transmitter boom 150, in accordance with an embodiment of the present invention.

Receiver capsule 120 houses a receiver or audio transducer (not shown) for transmission of sound to the user's ear based upon signals from an audio source 160 (FIG. 1A). The transducer can be any type of electromagnetic, piezoelectric, or electrostatic type of driving element, or a combination thereof, or another form of driving element, for generating sound waves from the output face of the transducer.

In one embodiment, receiver capsule 120 includes a hollow recess 124 for receiving a cable 162 that holds wires for transmitting electric signals from audio source 160 to the transducer housed in receiver capsule 120. In one example, hollow recess 124 is located approximately at the center of a top surface of receiver capsule 120, as shown in FIG. 1A but need not necessarily be positioned there. Instead, hollow recess 124 may be placed along various surfaces of receiver capsule 120 to effectively receive cable 162 without hindering movement of receiver capsule 120. In another example, cable 162 may first be received through a portion of either bias structure 140 or extension member 130 and then received by hollow recess 124.

Cable 162 is used to protect the wires and may be made from a non-conductive material, as is known in the art. The signals transmitted by cable 162 may be digital or analog in nature. The transducer converts the received electric signal to an audio signal and directs the audio signal toward the user's ear canal. In another embodiment, the transducer may receive signals through wireless communication channels, such as by Bluetooth™ protocols and hardware, in one example. In such an embodiment, cable 162 and wires held within cable 162 may no longer be necessary.

Receiver capsule 120 may be of various size and shape but preferably includes a circular faceplate (not shown) with a faceplate cushion 122. Faceplate cushion 122 is made of soft material, such as a foam elastomer, that is capable of transmitting sound from the transducer while also providing contact comfort for the user's ear after donning of the headset. In one example, with no intent to limit the invention thereby, the diameter of the transducer housed within receiver capsule 120 is between about 22 mm and about 24 mm. However, it should be noted that various applicable receiver capsules, such as in-the-ear type earphones, may also be used within the scope of the present invention.

Receiver capsule 120 is operably connected to extension member 130. Extension member 130 transfers a bias force from bias structure 140 to receiver capsule 120 for biasing of receiver capsule 120 against the user's ear in a direction substantially normal to the slope and/or orientation of the user's ear. Advantageously, such biasing of receiver capsule 120 against the ear in conjunction with earhook 110 allows for stable and enhanced acoustic coupling of the headset to the ear.

In one embodiment, extension member 130 is made of material that is sufficiently rigid to provide resistance to positional deformation and which allows for comfortable and safe biasing of receiver capsule 120 against the user's ear. For example, extension member 130 can be made from a non-abrasive material, such as a soft elastomer, plastic material, and the like. Many different materials with similar properties could be used within the scope of the invention.

In one embodiment, extension member 130 is shaped substantially as a fork with two projections 132, as shown in FIGS. 1A–1C. Receiver capsule 120 is movably coupled to the ends of projections 132. In one example, receiver capsule 120 is movably coupled to projections 132 by a swivel joint such that receiver capsule 120 is capable of swiveling along an axis A—A (FIG. 1A) connecting the ends of projections 132. Swiveling along such an axis will allow receiver capsule 120 to swivel in a direction substantially normal to the plane of earhook 110.

Extension member 130 is coupled to bias structure 140, which includes, in one example, two arms 141 and 142 coupled by a spring mechanism 143. As shown in FIGS. 1A–1C, in one embodiment, extension member 130 is coupled to arm 141 and earhook 110 is coupled to arm 142. In one example, extension member 130 is movably coupled to bias structure 140 via a pin or screw mechanism such that extension member 130 is capable of swiveling along an axis substantially perpendicular to axis A—A.

Such a movably coupled extension member 130 together with the swivel joint coupling receiver capsule 120 to extension member 130 advantageously allows receiver capsule 120 to bias flush against the user's ear conforming to the ear's slope and orientation for enhanced coupling.

As shown in FIG. 1B, when force is applied to bring together the free ends of arms 141 and 142 of bias structure 140, for example by two digits of the user's hand, earhook 110 is moved apart from extension member 130 and thus, from connected receiver capsule 120. This configuration constitutes an open or flexed configuration to allow for simple donning of over-the-ear headset 100 with one hand in accordance with an embodiment of the present invention.

Advantageously, earhook 110, bias structure 140, extension member 130, and movably connected receiver capsule 120 work in combination for enhanced acoustic coupling to the user's outer ear. In particular, over-the-ear headset 100 is able to closely conform to the shape and orientation of the user's ear to block out external noise while directing sound from the transducer to the eardrum. Excluding external sounds from the ear and providing increased coupling to the ear enhances the performance of over-the-ear headset 100 in a noisy environment.

Enhanced coupling is provided by transferring the bias from bias structure 140 (e.g., from spring mechanism 143), through extension member 130, and to movably connected receiver capsule 120, which allows for a biasing force substantially normal to the orientation of the user's ear. Simultaneously, earhook 110 is biased against the back area of the ear. Thus, receiver capsule 120 and earhook 110 "sandwich" the ear between them for enhanced positional stability.

Thus, earhook 110, bias structure 140, extension member 130, and receiver capsule 120 movably coupled to extension member 130, in accordance with the present invention, allow for biasing forces and orientation of receiver capsule 120 such that headset stability, acoustic coupling to the ear, and sound quality are greatly enhanced.

FIG. 1C illustrates the positioning of over-the-ear headset 100 mounted on a model ear in accordance with an embodiment of the present invention. After over-the-ear headset 100 is placed in an open or flexed configuration (FIG. 1B), earhook 110 is positioned behind the user's ear and receiver capsule 120 is positioned over the outer ear.

The force exerted on arms 141 and 142 of bias structure 140 is then removed so that receiver capsule 120 is biased against the outer ear with bias forces substantially normal to the orientation of the user's ear. Simultaneously, when the pressure on arms 141 and 142 is removed, earhook 110 will be biased against the back area of the ear toward receiver capsule 120. Advantageously, earhook 110 and receiver capsule 120 work in combination to sandwich the ear and provide for greater headset stability and coupling. Thus, since over-the-ear headset 100 contacts the ear along the back of the user's ear and along several parts of the outer ear with receiver capsule cushion 122, the multiple contact areas with the ear will distribute weight and pressure such that over-the-ear headset 100 is more stable on the ear, and the required contact force against the ear is reduced, which results in enhanced, long-term headset user comfort.

It is noted that earhook 110 may need to be flexed in order to be donned on the user's ear. The degree of angular flexure is dependent upon the size and shape of the user's ear. The general flexibility and resilience of earhook 110 in combination with bias structure 140, extension member 130, and receiver capsule 120, advantageously allow over-the-ear headset 100 to automatically adjust to the size and shape of the user's ear so as to be universally-fitting while providing stability and comfort.

In headsets used for telephonic or similar type communications, a microphone may be positioned in the vicinity of the user's mouth, usually by a tubular extension, voice tube, boom, or in-line pod, for receiving the user's voice and transmitting it over a telecommunications line.

Referring again to FIG. 1A, over-the-ear headset 100 may include a microphone 152 to enable two-way voice communication by the user in accordance with an embodiment of the present invention. In one embodiment, microphone 152 may be attached to a transmitter boom 150, which is operably connected to bias structure 140. Optionally, a movable joint, such as a swinging mechanism, may couple transmitter boom 150 to bias structure 140, such that boom 150 may swing back and forth to the user's mouth and lock into a position as desired by the user. Alternatively, transmitter boom 150 may be fixedly coupled to bias structure 140 with an adhesive or other fastening method and structure. It is noted that over-the-ear headset 100 may exclude transmitter boom 150 and microphone 152 for applications not requiring two-way voice communication. In another embodiment, a microphone may be enclosed in a pod inline with cable 162 below receiver capsule 120 to allow the user to transmit voice signals as desired.

Over-the-ear headset 100 is used with an audio source 160 (FIG. 1A), which can include a variety of audio sources, such as a telephone handset, a cellular phone, a personal computer, a media player, or a communication network. However, the invention is not limited to receiving a signal from a specific audio source. Over-the-ear headset 100 may also be used for either monaural or stereo listening by applying over-the-ear headset 100 to one or each ear of a user. It will be understood by those of ordinary skill in the art that a headset may be manufactured and donned that mirrors headset 100 so as to allow for use on either ear of a user.

Furthermore, a connector may be used to operably connect over-the-ear headset 100 to audio source 160. In one example, with no intent to limit the invention thereby, the connector is a 2.5 mm plug or a suitable adapter that allows coupling to the audio source device.

Figure 2A:
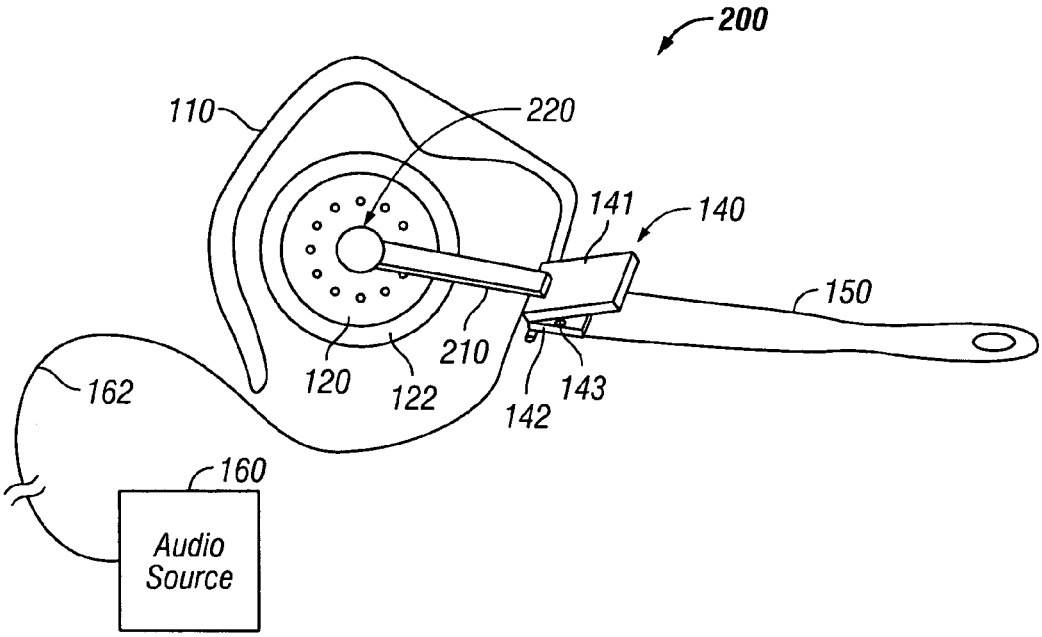
FIG. 2A illustrates a perspective view of an over-the-ear headset in a closed or relaxed configuration in accordance with another embodiment of the present invention.
Figure 2B:
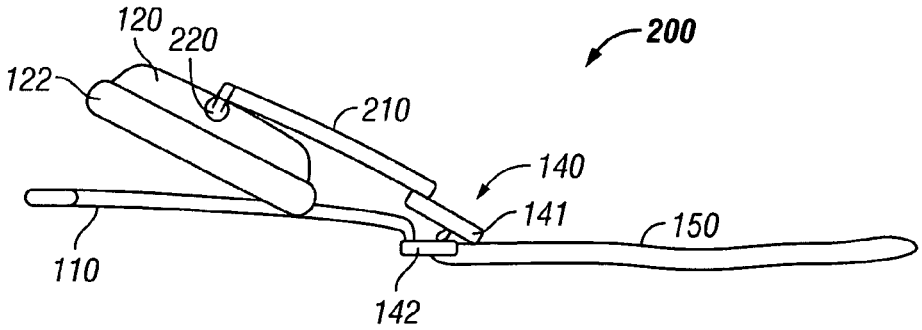
FIG. 2B illustrates a side view of the over-the-ear headset of FIG. 2A in an open or flexed configuration in accordance with an embodiment of the present invention.

FIGS. 2A and 2B show an alternative embodiment of the extension member in accordance with the present invention. In this embodiment, an extension member 210 of an over-the-ear headset 200 is shaped substantially as a beam and is used to operably connect receiver capsule 120 to bias structure 140. Receiver capsule 120 is movably coupled to an end of extension member 210 by a ball-and-socket joint 220 such that receiver capsule 120 is capable of motion along various axes. Advantageously, a ball-and-socket joint allows for greater freedom of motion for receiver capsule 120 and thus allows for greater conformability to the shape and orientation of a user's ear resulting in enhanced acoustic coupling. One example of a ball-and-socket joint that may be used is described in U.S. Pat. No. 5,761,298, issued on Jun. 2, 1998, to Davis et al. for "Communications Headset With Universally Adaptable Receiver and Voice Transmitter," which is commonly assigned and incorporated herein by reference for all purposes.

Over-the-ear headset 200 is operably connected to audio source 160 via wires in a cable 162 that enter receiver capsule 120 through a hollow recess on receiver capsule 120. In one embodiment, cable 162 may first be received through either bias structure 140 or extension member 210 and then be received by the hollow recess of receiver capsule 120. In a further example, cable 162 may be received by receiver capsule 120 through or approximate ball-and-socket joint 220. Over-the-ear headset 200 otherwise includes similar features and is donned in a similar manner as over-the-ear headset 100 described above.

Figure 3A:
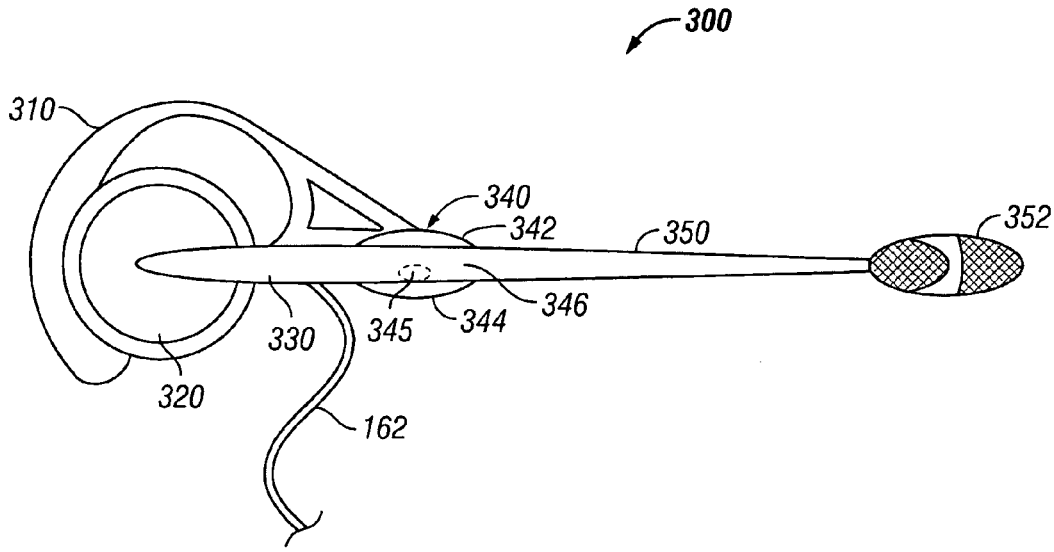
FIG. 3A illustrates a top view of an over-the-ear headset in accordance with another embodiment of the present invention.
Figure 3B:
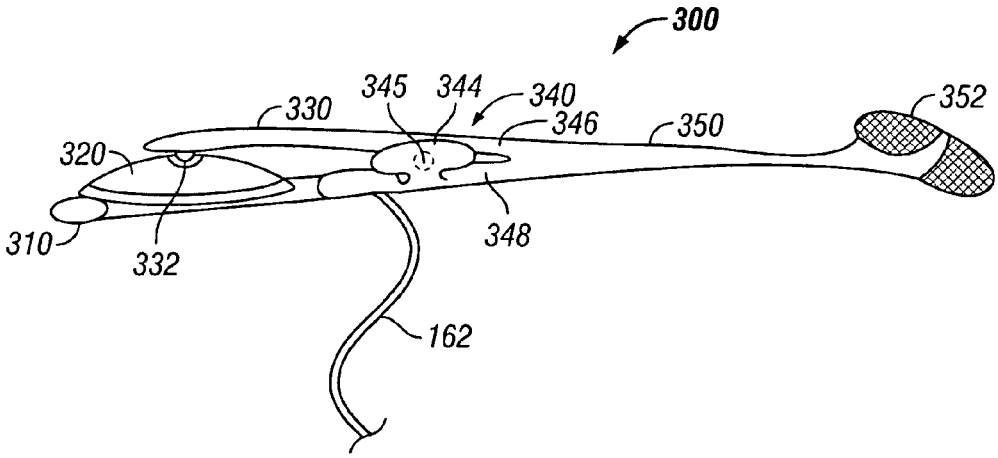
FIG. 3B illustrates a side view of the over-the-ear headset of FIG. 3A in accordance with an embodiment of the present invention.

FIGS. 3A and 3B illustrate an over-the-ear headset 300 including another embodiment of a bias structure in accordance with the present invention. Over-the-ear headset 300 includes an earhook 310, a receiver capsule 320, an extension member 330, a bias structure 340, and a transmitter boom 350, in accordance with another embodiment of the present invention.

Similar to over-the-ear headset 100 described above, various earhooks that are adapted to curve behind a ear in substantially a first plane may be utilized within the scope of the present invention.

Receiver capsule 320 is similar to receiver capsule 120 described above in conjunction with over-the-ear headset 100 illustrated in FIGS. 1A–1C and includes similar features and advantages.

Receiver capsule 320 is movably coupled to an end of extension member 330 by a ball-and-socket joint 332 such that receiver capsule 320 is capable of motion along various axes. Extension member 330 and ball-and-socket joint 332 are similar to the extension member and joint described above in conjunction with over-the-ear headset 200 and includes similar features and advantages.

Extension member 330 is coupled to bias structure 340, which includes in this embodiment a forked section with two projections 346 and 348. As shown in FIGS. 3A and 3B, in one embodiment, extension member 330 is coupled to projection 346 and earhook 310 is coupled to projection 348. Two separation tabs 342 and 344 are also coupled to projection 348 but may alternatively be coupled to projection 346.

Similar to bias structure 140 described above, bias structure 340 allows for simple donning of over-the-ear headset 300 with one hand in accordance with an embodiment of the present invention. When force is applied to the outside surface of separation tabs 342 and 344, for example by two digits of the user's hand, a part of each separation tab 342 and 344 is capable of being positioned between projections 346 and 348 to move the projections away from one another. Accordingly, over-the-ear headset 300 may be placed in an open or flexed configuration as earhook 310 is moved apart from extension member 330 and from connected receiver capsule 320, which allows for simple donning of the headset.

In one embodiment, separation tabs 342 and 344 each include a separation structure such as a ball 345 (outline shown by dashed lines) that can wedge between projections 346 and 348. Ball 345 is sized to move the projections away from one another and is made of a hard material that resists deformation. It should be understood that separation tabs 342 and 344 may have separation structures of various shapes and sizes based upon desirable separation parameters.

Separation tabs 342 and 344 are placed at a desired distance apart from the forked section where projections 346 and 348 meet. It is noted that as separation tabs 342 and 344 are placed closer to the forked section, projections 346 and 348 may be separated a larger distance from one another but more force may be required to wedge the separation structures between the projections. Hence, it should be understood that the separation tabs may be placed at various distances relative to the forked section based upon design considerations such as the shape and size of the separation structures. It is noted that only one separation tab may be necessary depending upon design considerations and parameters.

Enhanced coupling is provided by transferring the bias from bias structure 140 (e.g., from the shape, material, and resistance to flex of the forked section), through extension member 330, and to movably connected receiver capsule 320, which allows for a biasing force substantially normal to the orientation of the user's ear. Simultaneously, earhook 310 is biased against the back area of the ear. Furthermore, the movable joint connecting receiver capsule 320 to extension member 330 allows for receiver capsule 320 to be oriented substantially parallel to the orientation of the user's ear. Thus, receiver capsule 320 and earhook 310 are able to securely "sandwich" the ear for enhanced positional stability and acoustic coupling.

Over-the-ear headset 300 may optionally include a microphone 352 to enable two-way voice communication by the user in accordance with an embodiment of the present invention. In one embodiment, microphone 352 may be attached to a transmitter boom 350, which is operably connected to bias structure 340.

It is noted that earhook 310, extension member 330, projections 346 and 348, separation tabs 342 and 344, and boom 350 may be either separate components or formed as an integral component.

Over-the-ear headset 300 is operably connected to an audio source via a cable 162 and otherwise includes similar features and advantages and operates in a similar manner as over-the-ear headsets 100 and 200 described above.

The above-described embodiments of the present invention are merely meant to be illustrative and not limiting. Various changes and modifications may be made within the scope of this invention. Therefore, the appended claims encompass all such changes and modifications.

What is claimed is:

1. An over-the-ear headset, comprising:

an earhook adapted to fit at least partially behind an ear;

a bias structure coupled to the earhook, wherein the bias structure includes a clamp with a first arm and a second arm coupled by a spring;

an extension member coupled to the bias structure; and a receiver capsule movably coupled to a free end of the extension member.

2. The headset of claim 1, wherein the earhook and the extension member are coupled to different arms of the clamp.

3. The headset of claim 1, wherein the bias structure is capable of moving the earhook away from the extension member with application of force to the arms of the clamp.

4. The headset of claim 1, wherein the extension member comprises a single projection.

5. The headset of claim 4, wherein the receiver capsule is movably coupled to an end of the extension member by a ball-and-socket joint.

6. The headset of claim 4, wherein the earhook is adapted to curve at least partially around and behind the ear in substantially a first plane to grasp the ear, and the single projection is capable of being substantially parallel to the first plane of the earhook.

7. The headset of claim 1, wherein the extension member comprises a forked member including two projections.

8. The headset of claim 7, wherein the receiver capsule is movably coupled between the two projections of the forked member by a swivel joint.

9. An over-the-ear headset, comprising:

an earhook adapted to fit at least partially behind an ear;

a bias structure coupled to the earhook;

an extension member coupled to the bias structure, wherein the extension member comprises a forked member including two projections, the extension member being movably coupled to the bias structure; and a receiver capsule movably coupled to a free end of the extension member.

10. The headset of claim 9, wherein the earhook is adapted to curve at least partially around and behind the ear in substantially a first plane to grasp the ear, and the two projections of the forked member are capable of being substantially parallel to the first plane of the earhook.

11. The headset of claim 9, wherein the receiver capsule is movably coupled between the two projections of the forked member by a swivel joint.

12. The headset of claim 11, wherein the receiver capsule is capable of swiveling along an axis connecting the ends of the two projections of the forked member.

13. The headset of claim 12, wherein the extension member is capable of swiveling along an axis substantially perpendicular to the axis connecting the ends of the two projections of the forked member.

14. An over-the-ear headset, comprising:

an earhook adapted to fit at least partially around and behind an ear in substantially a first plane;

a bias clamp including a first arm and a second arm coupled by a spring, wherein an end of the earhook is rigidly coupled to the first arm of the clamp;

an extension member coupled to the second arm of the clamp; and a receiver capsule movably coupled to a free end of the extension member.

15. The headset of claim 14, wherein the bias clamp is capable of moving the earhook away from the extension member with application of force to the arms of the bias clamp.

16. The headset of claim 14, wherein the extension member comprises a forked member including two projections.

17. The headset of claim 16, wherein the two projections of the forked member are substantially parallel to the first plane of the earhook.

18. The headset of claim 16, wherein the receiver capsule is movably coupled between the two projections of the forked member by a swivel joint.

19. The headset of claim 14, wherein the extension member comprises a single projection.

20. The headset of claim 19, wherein the receiver capsule is movably coupled to an end of the single projection by a ball-and-socket joint.

21. The headset of claim 19, wherein the single projection is capable of being substantially parallel to the first plane of the earhook.

22. A method of donning an over-the-ear headset, the method comprising:

providing an over-the-ear headset, including an earhook adapted to fit at least partially behind an ear, a bias structure operably coupled to the earhook, wherein the bias structure includes a clamp with a first arm and a second arm coupled by a spring, an extension member operably coupled to the bias structure, and a receiver capsule movably coupled to a free end of the extension member;

providing force on the bias structure to move the receiver capsule away from the earhook;

positioning the earhook behind the ear;

positioning the receiver capsule over the ear; and removing the force on the bias structure to bias the receiver capsule against the ear.

23. The method of claim 22, wherein the bias is generated by a spring of the bias structure.

24. The method of claim 22, wherein the receiver capsule is biased flush against the ear, the orientation of the receiver capsule substantially conforming to an orientation of the ear after biasing the receiver capsule against the ear.

* * * * *